US005699866A

United States Patent [19]

Cousins et al.

[11] Patent Number: 5,699,866

[45] Date of Patent: Dec. 23, 1997

[54] SECTIONAL DRIVE SYSTEM

[75] Inventors: James E. Cousins, Shreveport; George R. Markiel, Benton; Ruben C. Boyter, Shreveport, all of La.

[73] Assignee: Perf Drill, Inc., Shreveport, La.

[21] Appl. No.: 644,372

[22] Filed: May 10, 1996

[51] Int. Cl.[6] ..... E21B 7/08

[52] U.S. Cl. ..... 175/78; 175/79

[58] Field of Search ..... 175/61, 62, 52, 175/75, 77, 78, 79

[56] References Cited

U.S. PATENT DOCUMENTS

| | | | |
|---|---|---|---|
| 1,367,042 | 2/1921 | Granville . | |
| 2,516,421 | 7/1950 | Robertson | 255/1.6 |
| 2,539,047 | 1/1951 | Arutunoff | 255/1.6 |
| 2,726,847 | 12/1955 | McCune | 255/1.6 |
| 2,778,603 | 1/1957 | McCune | 255/1.6 |
| 3,667,556 | 6/1972 | Henderson | 175/73 |
| 3,903,974 | 9/1975 | Cullen | 175/17 |
| 3,958,649 | 5/1976 | Bull et al. | 175/61 |
| 4,051,908 | 10/1977 | Driver | 175/78 |
| 4,185,705 | 1/1980 | Bullard | 175/78 |
| 4,368,786 | 1/1983 | Cousins | 175/78 |
| 4,442,908 | 4/1984 | Steenbock | 175/74 |
| 4,601,353 | 7/1986 | Schu et al. | 175/41 |
| 4,625,815 | 12/1986 | Spies | 175/73 |
| 4,658,916 | 4/1987 | Bond | 175/81 |
| 4,699,224 | 10/1987 | Burton | 175/61 |
| 4,880,067 | 11/1989 | Jelsma | 175/107 |
| 5,337,839 | 8/1994 | Warren | 175/62 |
| 5,373,906 | 12/1994 | Braddick | 175/67 |
| 5,392,858 | 2/1995 | Peters et al. | 166/298 |
| 5,413,184 | 5/1995 | Landers | 175/62 |

*Primary Examiner*—Frank Tsay
*Attorney, Agent, or Firm*—John M. Harrison

[57] ABSTRACT

A sectional drive system for transmitting power linearly or in a curved path to an output, which system includes multiple, tapered and splined, interlocking driving segments which are nested and stacked as a segment string that is rotatable in a guide path. The top one of the segments cooperates with a drive mechanism to effect rotation of the nested segments in concert and the bottom one of the segments connects to a suitable output such as a drill bit. Articulation of the segments with respect to each other due to matching asymmetrical splines and companion spline slots facilitates dampening of drive vibration and bending of the segment string in the guide path in any desired direction to facilitate transmitting power in a curved path of desired magnitude from the drive mechanism to the output. In a typical application the interlocking driving segments are incorporated in a downhole drilling apparatus designed for insertion in a well bore to facilitate drilling holes at selected angles in an uncased hole or through the well casing, cement sheath and producing interval to enhance well production. The driving segments and bit will continue travelling in a straight line and continue on the same path presented when existing the guide path from the downhole drilling apparatus.

20 Claims, 3 Drawing Sheets

SECTIONAL DRIVE SYSTEM

BACKGROUND OF THE INVENTION

1. Field of the Invention

This invention relates to drive systems for transmitting power to an output and more particularly, to a sectional drive system which is characterized by multiple, tapered and splined, interlocking and articulating driving segments that are characterized by asymmetrical exterior splines having specially designed drive faces and matching interior spline slots and are nested and stacked and rotate in concert as a segment string in a selected guide path. The guide path may be straight or curved, and in the latter case, the interlocking driving segments articulate to dampen drive vibration, define the curve and facilitate transmission of power from a drive mechanism to an output device. The nested, stacked and articulated segment string can therefore be used as a drive train in any application where transfer of power and torque are required in a straight line or at substantially any selected angle or deviation from the straight line. The sectional drive system may, for example, be used to effect horizontal drilling or coring of producing hydrocarbon intervals in oil and gas wells, utilizing the multiple, stacked and tapered, interlocking driving segments driven by a downhole drilling motor at one end of the segment string to operate a bit connected to the opposite end of the segment string. Retrieval of the segment string from the interval is facilitated by a cable extending through openings in the driving segments. Consequently, the sectional drive system of this invention can be used in a downhole drilling apparatus to more efficiently effect drilling deviation in a controlled manner from a vertical or substantially vertical well bore.

Production of hydrocarbons from oil and gas wells involves initially drilling a well bore to or through the producing interval and usually, though not always, sealing a casing in the bore by pumping cement into the annular space between the bore and casing. Because the porosity of production intervals varies and due to the presence of many other factors in the drilling process, it is often necessary to provide lateral perforations or drain holes in the production interval for collection of the hydrocarbon fluid in the well bore. Conventional techniques for achieving this objective are frequently difficult to implement and the results sometimes defy accurate prediction. Furthermore, these production-enhancing techniques are generally not sufficiently effective to penetrate the producing formation to any appreciable extent and under circumstances where considerable damage is realized to the formation during the drilling and casing-setting operations, the perforations may not penetrate beyond the damaged area. The most important benefit of a drain hole or holes in the production interval or zone of an oil or gas well is that of increasing the amount of formation surface exposed to the well bore for drainage of production fluid into the well bore. In addition to this desirable formation exposure, it has been found that there is a potentially significant relationship between horizontal perforation or drain hole depth and an increase in bottom-hole pressure. The productivity of a completed and perforated well depends upon the number of drain hole perforations in the production interval, the diameter and depth of penetration of the perforations and the distribution of the perforations. Production in many wells has decreased over the years to the point of marginal profitability, in part due to a collapse of the drain hole walls, perforation contamination and many other problems which substantially reduce the flow of hydrocarbon fluid from the producing interval, into the well bore.

Another technique for creating drain openings, bores or perforations which communicate with a well bore for enhancing the drainage of production hydrocarbons from a producing interval, is use of a whipstock tool, which is seated in the casing at a desired well depth. After several trips in and out of the well to mill the whipstock slot in the casing, the drill string is inserted in the well and the bit is deflected through the whipstock slot, into the producing interval.

The art of horizontal drilling from a vertical well bore is essentially the same as drilling a drain hole in the cased well and the results are significantly increased formation exposure. The horizontal deviation is far more efficiently achieved when drilling is effected by a bendable or articulating drilling string.

While capable of being operated in an extremely efficient manner to permit horizontal or angular drilling of drain hole perforations in oil wells, the sectional drive system of this invention can also be implemented to transmit power from substantially any drive system to an output apparatus, drive or other system under circumstances where the power is to be transmitted in a curved line. Accordingly, the sectional drive system of this invention may be used to transmit power from an engine or motor to the wheels of automobiles, mud motors and like apparatus and equipment, as well as dental drills, robotic devices and material handling equipment, in non-exclusive particular.

2. Description of the Prior Art

Conventional techniques for effecting the transmission of power between a power source and an output under circumstances where the power is to be transmitted in an offset or curved manner, includes use of the mechanical devices as coupling mechanisms such as a universal or "CV" joint, which coupling mechanisms are well known to those skilled in the art. For example, many devices have been designed for lowering into an oil or gas well for the purpose of boring and drilling holes at right angles to the well bore at the production interval, but many problems have been encountered in using these systems. Typically, the relatively low bit rotational speed generally necessitated by using curved shafts of various design sometimes requires excessive time to achieve significant penetration, and increasing the bit rotational speed and shaft load frequently causes failure of the shafts. Accordingly, these conventional horizontal drilling devices have not proved capable of sustaining the high compressive loads necessary to penetrate the well casing, concrete sheath, rock and producing interval in a well within an economical time frame without failure. Other problems have been encountered, such as bit retrieval and freedom of rotation of the drilling string in such applications.

Among the directional drilling apparatus designed to achieve this function are those detailed in the following U.S. Pat. No. : 3,667,556, to Henderson; U.S. Pat. No. 4,051,908, to Driver; U.S. Pat. No. 4,185,705, to Bullard; U.S. Pat. No. 4,442,908, to Steenbock; U.S. Pat. No. 4,601,353, to Schuh et al; U.S. Pat. No. 4,625,815, to Spies; U.S. Pat. No. 4,658,916, to Bond; U.S. Pat. No. 5,337,839, to Warren et al; U.S. Pat. No. 5,392,858, to Peters et al; U.S. Pat. No. 5,413,184, to Landers; U.S. Pat. No. 2,516,421, to Robertson; U.S. Pat. No. 2,539,047, to Arutunoff; U.S. Pat. No. 2,726,847, to McCune et al; U.S. Pat. No. 2,778,603, to McCune et al; U.S. Pat. No. 3,903,974, to Cullins; U.S. Pat. No. 4,699,224, to Burton; U.S. Pat. No. 4,880,067, to Jelsma; and U.S. Pat. No. 5,373,906, to Braddick.

In addition to the boring of horizontal openings through the well casing and into the producing interval, other techniques for achieving production of hydrocarbons from producing intervals of oil and gas wells include "perforating" the zone or production surrounding the well bore by means of perforating guns which are lowered into the well bore and fire explosive charges through the well casing and concrete sheath into the production zone to create drain holes which allow hydrocarbons to flow from the production strata into the well bore. Still other methods include the use of shaped charges which explode and "jet" an aperture into the formation to create the desired hydrocarbon drainage. However, as noted above, most of these devices do not have sufficient force to penetrate deeply into the formation and the projectiles or explosive charges must penetrate the casing, a cement sheath and a compressed, consolidated damaged area of the formation lying adjacent to the cement sheath. Improved techniques which use equipment capable of achieving deeper projectile penetration and maximum back surging to clean the drain holes are capable of effecting only limited penetration into the production strata, even under ideal conditions. Other techniques include using chemical charges such as thermite which are ignited and create an extremely hot charge that burns through the casing, concrete and hydrocarbon-bearing zone. However, these devices can be unreliable and are often not able to penetrate deeply enough into the "pay" zone to achieve a significant increase in hydrocarbon flow. Furthermore, recent studies indicate that the perforations effected by these techniques usually close or clog over time, thus severely reducing the drainage capability of the producing interval.

It is an object of this invention to provide an articulated sectional drive system for transmitting power linearly or in a curved path to an output of selected character.

Another object of this invention is to provide a sectional drive system for transmitting power linearly or in a curved path from a source of power to an output, which sectional drive system includes multiple, tapered and splined interlocking driving segments that are rotatably stacked and nested and rotate as a segment string responsive to application of power to one end of the segment string to operate the output at the opposite end.

A still further object of this invention is to provide a sectional drive system of selected length and size, which drive system includes multiple, tapered and splined interlocking driving segments that include asymmetrical splines having protruding drive faces and spline slots or seats for receiving the splines and are rotatably stacked and nested and articulate as a segment string in a guide path such as a tube, for dampening drive mechanism vibration and transmitting power between the drive system and a suitable output.

Yet another object of this invention is to provide a sectional drive system for drilling one or more drain holes of selected depth and angle into a producing interval of an oil or gas well to increase the flow of hydrocarbons or gas from the interval into the well bore.

Still another object of this invention is to provide a sectional drive system and down-hole drilling apparatus for drilling drain or core holes to selected depths at various angles with respect to a vertical well hole or bore in an oil or gas well, which apparatus is capable of being lowered into the well by coiled tubing, conventional tubing, wireline or other means, stabilized in the well bore and activated to drill the holes or cores of selected size and depth in the test or hydrocarbon-producing strata.

A still further object of this invention is to provide a self-contained sectional drive system characterized by multiple, tapered, splined and interlocking driving segments that may be rotatably stacked, nested and articulated on a cable as a segment string in a straight or curved guide path, one end of which segment string is connected to a drive apparatus such as a mud motor and the opposite end to a drill bit. The segment string is rotated by the mud motor to drill a hole through the well casing, concrete and undamaged production formation and increase the flow of hydrocarbons into the well bore.

A still further object of this invention is to provide a self-contained down-hole drilling, coring and casing-cutting device which is characterized by multiple, tapered, splined interlocking and articulating driving segments of selected length and having asymmetrical engaging splines and angular drive faces on the splines, as well as asymmetrical receiving slots or receptacles for engaging the splines in driving relationship, which driving segments are stacked and nested and are designed to rotate in concert as a segment string in a straight or curved guide tube and dampen motor vibration and which segment string is connected at one end to a drive mechanism such as a mud motor and at the other end to a drill bit. The segment string may be lowered in a down-hole drilling apparatus housing into a well bore adjacent to a producing strata or interval and activated to bore through the well casing, concrete sheath and production interval and create one or more drain holes for enhancing the flow of hydrocarbons into the well bore and particularly, for enhancing hydrocarbon production from characteristically slow flowing formations such as chalk or similar formations and aiding artificially induced secondary and tertiary hydrocarbon recovery systems such as water, steam and fire floods. Alternatively, the housing may be positioned in the well bore, the segment string operated to drill through the casing and the housing then slowly lowered in the well bore to cut an opening, window or slot of selected size in the casing, for enhanced directional drilling purposes.

Still another object of the invention is to provide a transverse down-hole drilling system which is self-contained and includes multiple cable-mounted, tapered, splined, interlocking driving segments that rotate in concert as a segment or drive string and articulate with respect to each other, a curved guide path, groove or tube shaped in such a manner as to permit sufficient lateral movement to traverse at least a ninety-degree guide path bend, with a drill bit attached to the lower end of the string and a down-hole electric or hydraulic drilling motor coupled to the upper end of the segment string for effecting rotation of the driving string and drill bit.

SUMMARY OF THE INVENTION

These and other objects of the invention are provided in a new and improved sectional drive system for transmitting power from a drive source or apparatus of selected character to an output device of selected design, especially under circumstances where the drive apparatus and the output device are misaligned, the sectional drive system including multiple, tapered and splined interlocking driving segments which include eight spaced, asymmetrical splines having angular drive faces and eight asymmetrical slots for receiving the splines in driving relationship, which driving segments are slidably mounted on a cable and stacked and nested as a rotatable, articulating segment string, one end of which string is attached to the drive mechanism and the opposite end to the output device.

In a preferred embodiment of the invention the sectional drive system is incorporated in a down-hole drilling apparatus which includes a tubular housing containing at least one curved guide groove, path or tube having a selected radius, a ninety-degree path for containing and guiding a segment string formed by multiple, tapered, splined drive string segments which interlock and nest and are driven by a self-contained drive mechanism to dampen motor vibration and force a drill bit attached to the lowest of the segments and the accompanying drive string through the well casing, concrete sheath and into the produceable formation. According to a preferred embodiment of the invention, the string of articulating segments is removed from the drilled drain hole by means of the cable running through the center of the segments and attached to the drill bit. In another preferred embodiment the down-hole transverse drilling apparatus can be lowered into a well bore adjacent or above the producing or produceable strata or formation to facilitate extension of the segment string along the guide groove, path or tube and boring through the well wall transverse from the primary well bore and into the production interval, to create a horizontal drain hole for enhancing the flow of hydrocarbons into the well bore, and particularly, for enhancing hydrocarbon production from characteristically slow-flowing formations such as chalk or highly consolidated sands and aiding in artificially induced secondary and tertiary hydrocarbon recovery systems such as water, steam and fire floods.

BRIEF DESCRIPTION OF THE DRAWINGS

The invention will be better understood by reference to the accompanying drawings, wherein.

DESCRIPTION OF THE PREFERRED EMBODIMENTS

Figure 1:
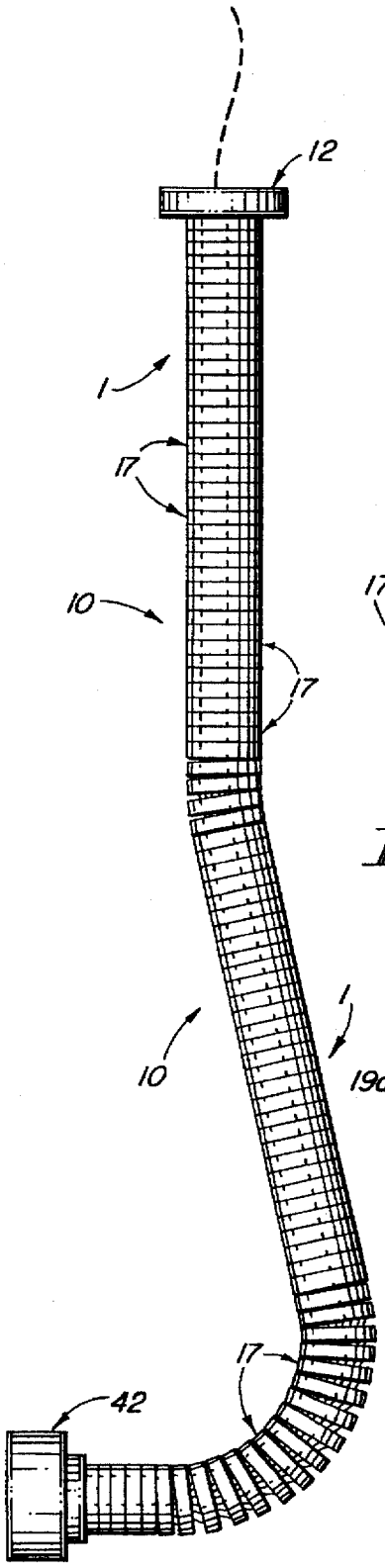
FIG. 1 is a side view of a typical sectional drive system of this invention, driven at one end by a suitable drive apparatus for rotating an output device on the opposite end.
Figure 2:
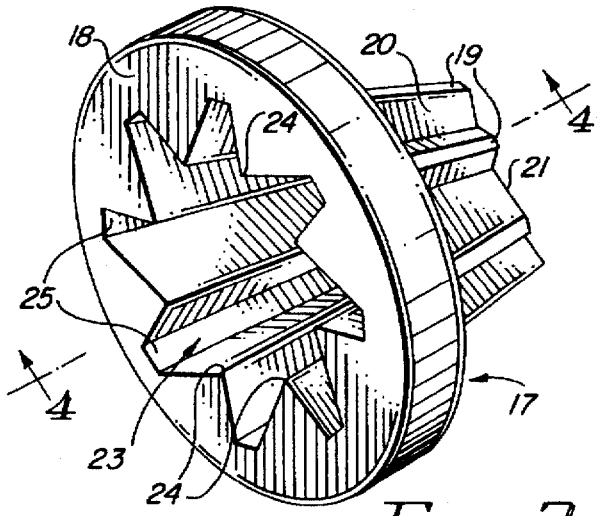
FIG. 2 is a perspective view of a typical drive segment element in the sectional drive system illustrated in FIG. 1.
Figure 3:
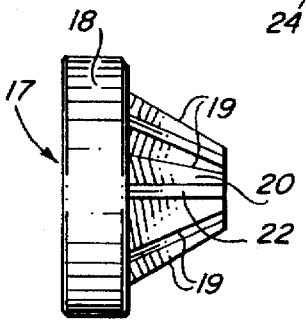
FIG. 3 is a side view of the drive segment element illustrated in FIG. 2.
Figure 4:
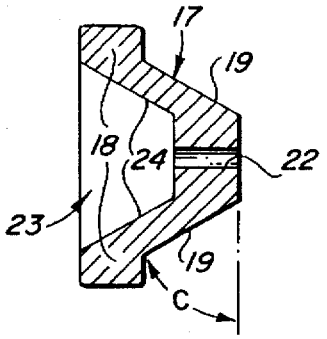
FIG. 4 is a sectional view taken along line 4—4 of the drive segment illustrated in FIG. 2.
Figure 5:
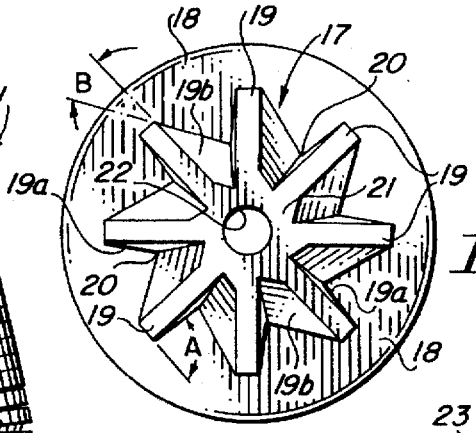
FIG. 5 is a front view of the drive segment illustrated in FIG. 2, more particularly illustrating the asymmetrical exterior splines and exterior spline slots.
Figure 6:
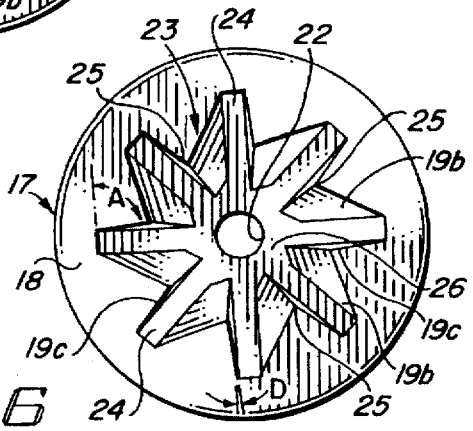
FIG. 6 is a rear view of the drive segment illustrated in FIG. 1, more particularly illustrating the asymmetrical interior splines and interior spline slots.

Referring now to FIGS. 1–6 of the drawings the sectional drive system of this invention is generally illustrated by reference numeral 1. The sectional drive system 1 is characterized by a drive string 10 formed by stacking multiple drive segments 17, each of which drive segments 17 includes a flat, round segment head 18 and longitudinally tapering, asymmetrical exterior splines 19, recessed from the perimeter of the segment head 18, as illustrated in FIGS. 3–6. In a preferred embodiment of the invention each of the drive segments 17 is shaped to include eight asymmetrical exterior splines 19, each having an angular drive face **19*a* and each of which taper in a direction transverse to the longitudinal axis of the exterior splines 19 to define eight, asymmetrical exterior spline slots 20 in a repetitive, geometric pattern, which resembles an eight point star when viewed from the bottom, as illustrated in FIG. 5. As further illustrated in FIG. 5 the taper of the asymmetrical exterior splines 19 transverse to the longitudinal axis of the asymmetrical exterior splines 19 is uneven or asymmetrical, with the right-hand clockwise taper across the respective angular drive faces 19*a* being more steep than the taper in the opposite spline wall 19*b*. In a most preferred embodiment the bottom edge of each spline wall 19*b* extends from along the top surface of the segment head 18 at an angle "B" of from about ten degrees to about 45 degrees with respect to the edge of the corresponding exterior spline 19 lying adjacent to the spline wall 19*b*, for optimum spline strength. The spline walls 19*b* terminate at a flat tip 21, having a tip aperture 22 in the center thereof and extending through the tip 21 into the hollow segment interior 23 of each of the drive segments 17, as illustrated in FIGS. 2 and 4. As further illustrated in FIG. 5 the angle "A" defined by the angular drive face 19*a* and a flat edge of an asymmetrical exterior spline 19 is preferably in the range of from about 80 degrees to about 90 degrees and most preferably, about 85 degrees, for optimum driving characteristics. Referring again to FIGS. 2, 3 and 6, the segment interior 23 of each of the drive segments 17 includes multiple, spaced, asymmetrical interior spline seats 24, which project into the segment interior 23 and correspond to the correspondingly-shaped exterior splines 19, respectively. The interior spline seats 24 extend from the surface of the segment head 18 to the flat tip seat 26, which corresponds to the tip 21 on the asymmetrical exterior splines 19, illustrated in FIG. 5. The interior spline seats 24 are also tapered transversely to the longitudinal axis of the interior spline seats 24 to define the interior splines 25, the latter of which correspond to the asymmetrical exterior spline slots 20, respectively. In a preferred embodiment of the invention the angle "A" defined by the angular driven face 19*c* and a flat edge of an interior spline seat 24 is in the range of from about 80 to about 90 degrees, and preferably about 85 degrees. Accordingly, the drive segments 17 will nest, stack and interlock and yet articulate transversely with respect to each other in driving relationship to shape the drive string 10 as illustrated in FIG. 1, with the asymmetrical exterior splines 19 of one segment registering with the interior spline seats 24 of an adjacent segment. This interlocking registration is not rigid, but permits lateral, or transverse movement of the drive segments 17 in the interlocking and nested configuration, such that the drive segments 17 can easily bend and articulate to conform to the bend illustrated in FIG. 1, and yet maintain an interlocking, driving relationship of high integrity due to the matched drive faces 19*a* and driven faces 19*c*, which articulation also serves to dampen the eccentric or other vibration of the drive motor 12, illustrated in FIG. 1. Referring again to FIGS. 5 and 6 the drive segments 17 are designed such that the internal spline seats 24 are rotatably offset with respect to the exterior splines 19. This offset is preferably at a rotational angle "D" in the range of from about 4 degrees to about 8 degrees, and most preferably about 6 degrees. This rotational angle "D" insures sufficient wall thickness of the respective exterior splines 19. This lateral movement of the drive segment 17 in the registered and stacked configuration facilitates application of torque to the top of the drive string 10 by means of a drive motor 12 of selected design to rotate the drive string 10 and the output 42 attached to the opposite end of the drive string 10, as further illustrated in FIG. 1. Optimum engagement of the respective exterior splines 19 and the interior spline seats 24 is effected by recessing the exterior splines 19** from the periphery of the segment head 18 to facilitate complete nesting and stacking of the drive segments 17, as illustrated in FIG. 1. In another most preferred embodiment of the invention the angle "C" of taper of the interior spline seats 24 and the asymmetrical exterior splines 19 from the segment head 18 to the tip 21, defined as the spline wall 19*b*, is in the range of from about 10 degrees to about 45 degrees and most preferably, about 30 degrees with respect to the vertical when one of the drive segments 17 are viewed with the segment head 18 positioned upwardly, as illustrated in FIG. 5. This structuring of the drive segments 17 facilitates a drive string 10 which is capable of bending or articulating with a separation angle "E", illustrated in FIG. 8, of 0 to approximately 5 degrees for each one of the drive segments 17 utilized in the drive string 10, to facilitate traversal of the bend illustrated in FIG. 1 and yet maintain optimum interlocking contact between the angular drive faces 19*a* and driven faces 19*c* to effect driving rotation of the selected output 42 responsive to power applied to the drive string 10 by the selected drive motor 12.

Figure 7:
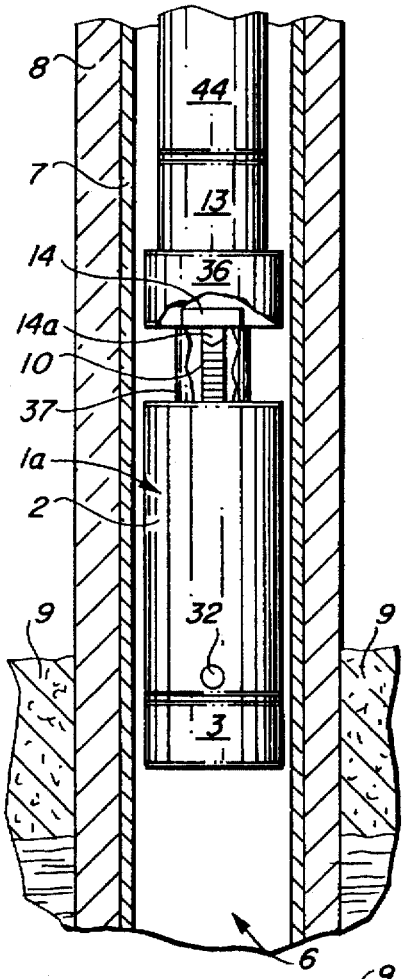
FIG. 7 is a side view, partially in section, of a typical down-hole drilling apparatus which incorporates the sectional drive system illustrated in FIG. 1 to drill transverse drain holes through the well casing into the producing interval of a well.
Figure 8:
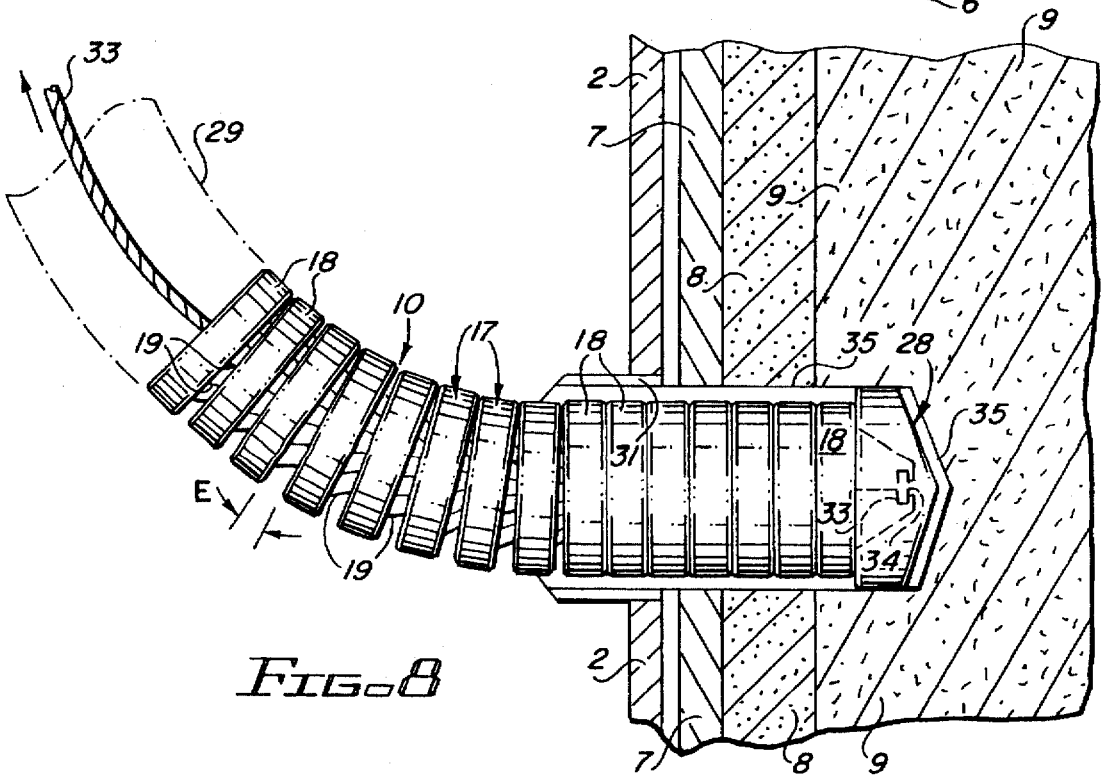
FIG. 8 is a side sectional view of the sectional drive system illustrated in FIG. 1 mounted in a guide groove that defines a guide path into the producing interval.
Figure 11:
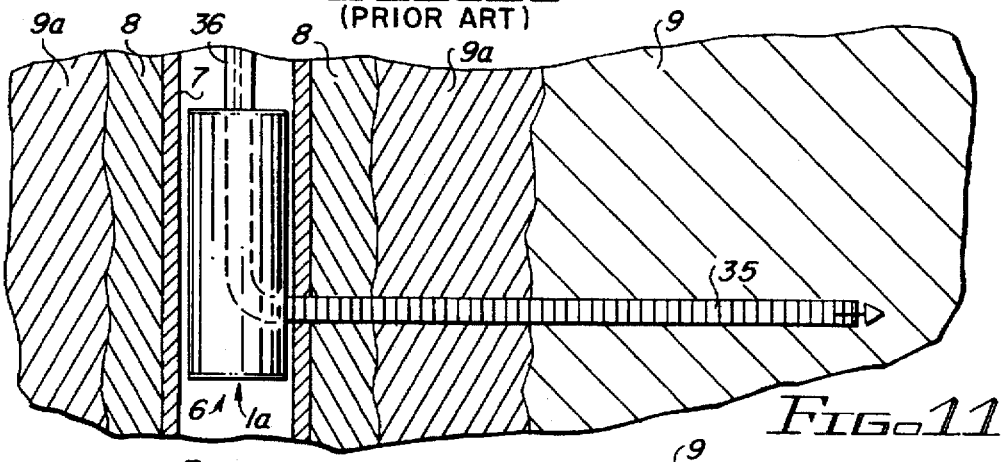
FIG. 11 is a schematic of a down-hole drilling apparatus containing the sectional drive system of this invention in operable position in a well, for drilling a transverse drain bore opening.

Referring now to FIGS. 7, 8 and 11 of the drawings, a typical application of the sectional drive system 1 of this invention is operation of the down-hole drilling apparatus 1*a*. The down-hole drilling apparatus 1*a* includes a generally cylindrically-shaped housing 2 having a stabilizer or packer 3 mounted on the bottom thereof. The down-hole drilling apparatus 1*a* is suspended, typically by means of a drill pipe or tubing string 44, attached by means of a coupling 36 to a mud motor 13, fitted with a drive shaft housing 37, enclosing a drive shaft (not illustrated) which is connected to mud motor bit box 14, in the well bore 6 of an oil or gas well, to a point adjacent to a zone of hydrocarbon production or interval, illustrated in FIGS. 7 and 8 by reference numeral 9. Casing 7 is typically mounted in the well in conventional fashion by means of a cement sheath 8 and the diameter of the housing 2 is slightly smaller than the inside diameter of the casing 7 to permit the down-hole drilling apparatus 1*a* and attached mud motor 13 to be raised and lowered inside the casing 7 by the drill pipe or tubing string 44, or by any other convenient technique, such as a wireline (not illustrated) in order to position the down-hole drilling apparatus 1*a* in alignment with the hydrocarbon-producing interval 9. The mud motor bit box 14 is connected to the drive string 10, illustrated in FIG. 8, by means of the coupling 36 and a bit box segment 14*a* is shaped to engage the top one of the drive segments 17 in the drive string 10. The thickness of the producing interval 9 is determined by conventional well logging techniques well known to those skilled in the art.

Referring again to FIGS. 7 and 8 of the drawings the downhole drilling apparatus 1*a* is illustrated partially in section and includes a guide path defined by a path or tube 29 having a bottom end 31 exiting at the lower end of the housing 2 and closed by a thin plug 32 provided in the housing 2. The guiding path or tube 29 curves upwardly from the plug 32 to define a ninety-degree bend across the inside diameter of the housing 2 and terminates in upward-extending relationship at a top end of the path or tube 29 (not illustrated) positioned beneath the mud motor bit box 14, illustrated in FIG. 7.

Figure 9:
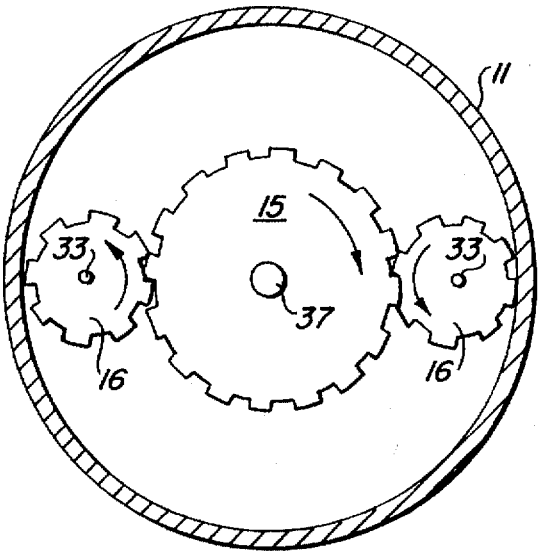
FIG. 9 is a sectional view of a typical drive motor for driving the drive string illustrated in FIGS. 1 and 8.

Referring now to FIGS. 1 and 9 of the drawings a typical alternative drive system for rotating the drive string 10 is characterized by a drive motor 12, mounted in or on the housing 2 and fitted with one or a pair of drive string gears 16, the bottom or bottoms of which, like the bit box segment 14*a* in the drive embodiment described above, are shaped to define asymmetrical exterior splines 19, exterior asymmetrical spline slots 20 and tips 21, respectively, as illustrated in FIG. 5 with respect to the drive segments 17, in order to interlock and nest with the corresponding interior spline seats 24 of the top one of the drive segments 17. The drive gear 15 is attached to a motor (not illustrated) by means of a drive shaft 37, as illustrated in FIG. 9.

Referring again to FIG. 8 of the drawings in a preferred embodiment of the invention the drive segments 17 are slidably strung on a segment cable 33, one end of which is fitted with a cable stay or anchor 34 located inside the segment bit 28 and the other end threaded through the tip aperture 22 of the last one of the drive segments 17 and the drive string 10 and then through the tip aperture 22 of each of the nested drive segments 17, for attachment to the drive shaft 36. The segment bit 28 is internally configured in the shape of the segment interior 23, illustrated in FIGS. 2 and 6, to facilitate rotating the segment bit 28 by rotation of the drive string 10 by either the bit box segment 14*a* or the drive motor 12, as described above. In this manner, one or more drain holes 35 can be drilled according to the procedure hereinafter outlined and the drive string 10 can be retrieved from the drain hole 35 by application of the segment cable 33, as illustrated in FIG. 8. In a most preferred embodiment of the invention the segment bit 28 is about 20% larger than the drive segments 17 to better facilitate retrieval of the drive string 10 and to facilitate the removal of debris from the drain hole 35 as the drive string 10 and the segment bit 28 are removed from the drain hole 35. Furthermore, in this embodiment of the invention, the bottom end 31 of the guide path or tube 29 is flared or enlarged as illustrated in FIG. 8, to accommodate the enlarged segment bit 28.

In operation, and referring again to FIGS. 1–9 of the drawings, the sectional drive system 1 of this invention operates in the down-hole drilling apparatus 1*a* of appropriate size to fit inside the casing 7 of a well or in an uncased well. The housing 2 is lowered by means of drill pipe or tubing string 44 or a wireline cable (not illustrated), attached to the housing 2, into the well bore 6, defined by the casing 7, to a desired predetermined point adjacent to a hydrocarbon-producing interval 9, as illustrated in FIG. 7. The packer 3 is then conventionally activated to secure the down-hole drilling apparatus 1*a* in the casing 7 and the drive motor 12, which may be a mud motor 13 (a positive displacement motor), an electric motor or other driving apparatus, such as the drive apparatus illustrated in FIG. 9, is energized. This action causes the drive shaft (not illustrated) to turn inside the drive shaft housing 37 and the drive string 10 to rotate in the guide path or tube 29 with the bit box segment 14*a*, as illustrated in FIGS. 7 and 8. As the segment bit 28 rotates and the drill pipe or tubing string 44 is lowered, the drive shaft housing 37 slides within the housing 2 and the segment bit 28 bores initially through the plug 32 in the bottom end 31 of the guide tube 29 and subsequently through the casing 7, (or directly through the wall of the well bore 6, under circumstances where the well is uncased). The segment bit 28 then bores through the cement 8 and finally drills into the producing interval 9, as further illustrated in FIG. 8. Advancement of the segment bit 28 and the drive string 10 through the producing interval 9 to create the drain hole 35 is effected by the weight of the drive shaft housing 37, the mud motor 13 and the drill pipe or tubing string 44, which bears on the drive string 10 and applies sufficient pressure on the nested drive segments 17 to cause the segment bit 28 to bore through the surrounding producing interval 9. When it is desired to remove the drive string 10 from the drain hole 35, tension is applied to the drill pipe or tubing string 44 or the conventional wireline cable (not illustrated) connected to the housing 2, to raise the housing 2 and remove the drive string 10 from the drain hole 35 by the action of the segment cable 33. Under circumstances where it is desired to leave the drive string 10 in the drain hole 35 to drain unconsolidated formations, the segment cable 33 may be omitted from the drive string 10.

Figure 10:
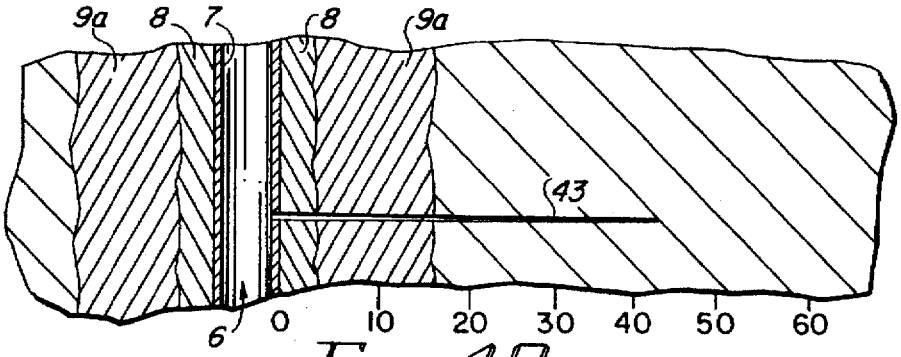
FIG. 10 (PRIOR ART)
FIG. 10 is a schematic of a typical conventional perforation in a producing interval of a well to facilitate enhanced drainage of the interval.
Figure 12:
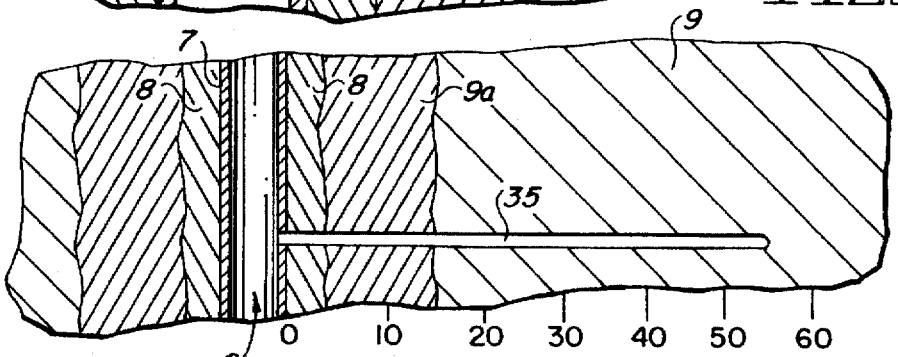
FIG. 12 is a schematic of the transverse drain bore or opening drilled by the down-hole drilling apparatus illustrated in FIG. 11.
Figure 13:
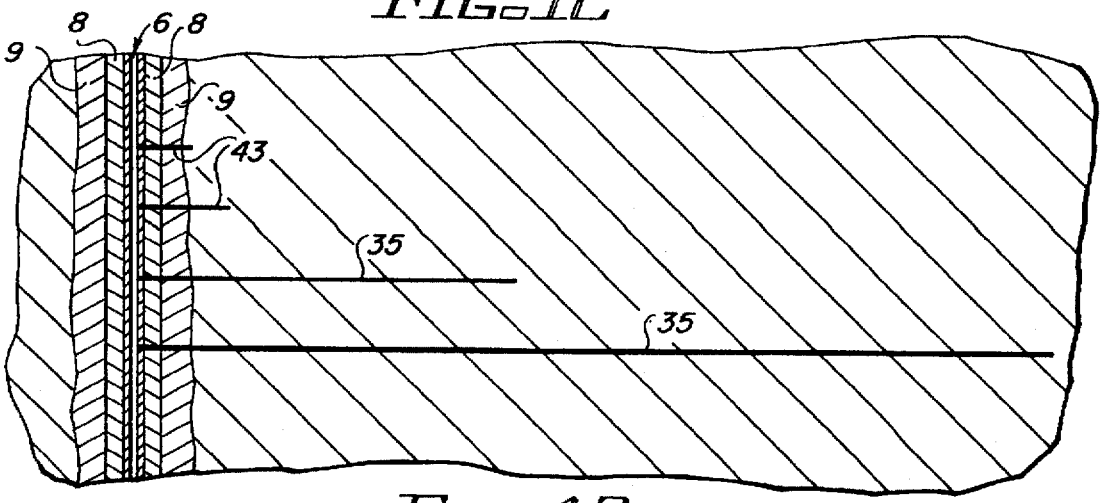
FIG. 13 is a schematic comparing the relative lengths of a pair of conventional interval perforations and transverse drain bores completed by a down-hole drilling apparatus utilizing the sectional drive system of this invention.

Referring now to FIG. 10 of the drawings, a schematic of a typical well bore perforation that extends into the producing interval 9 from the perforated casings 7 of the well illustrates the limited penetration and hole size of a potential drain hole or opening in the producing interval 9. These perforations are effected by means of "perforating guns" or other techniques heretofore described for increasing the drainage of hydrocarbons from the producing interval 9 into the well bore 6 of the well. In contrast to the size of the perforation 43 illustrated in FIG. 10, a much larger and longer drain hole 35 can be effected in the producing interval 9 by operation of the down-hole drilling apparatus which incorporates a sectional drive system 1 as described above and is further illustrated in FIG. 12. Furthermore, any desired number of drain holes 35 can be drilled in the producing interval 9 utilizing a down-hole drilling apparatus 1 and the sectional drive system 1 of this invention to facilitate a desired optimum drainage of the producing interval 9, regardless of the character of the producing interval 9, utilizing the techniques illustrated in FIGS. 7–9 and 11. Moreover, referring now to FIG. 13 of the drawings, a comparison is illustrated of the conventional techniques for penetrating the casing 7, cement sheath 8 and the producing interval 9 in limited fashion for the perforation 43 and a drain hole 35 of selected length and size, which may be drilled through the casing 7, the cement sheath 8 and into the producing interval 9 to a desired extent to create a drain hole 35 of selected dimensions for much more efficiently draining the producing interval 9 of hydrocarbons.

Referring again to FIGS. 1–6 of the drawings it will be appreciated by those skilled in the art that substantially any number of exterior splines 19, exterior spline slots 20, interior spline seats 24 and interior splines 25 can be provided in the design of the drive segments 17. However, in a most preferred embodiment of the invention eight asymmetrical exterior splines 19, exterior spline slots 20 and matching asymmetrical interior spline seats 24 and interior splines 25 are provided for each one of the drive segments 17 in the drive string 10, as illustrated. In a most preferred embodiment the eight exterior splines 19 and interior spline seats 24 are equally tapered at the spline walls **19*b*, as heretofore described and the exterior splines 19 and exterior spline slots 20 are about 3% smaller than the interior spline seats 24 and the interior splines 25, for optimum smoothness and meshing during separation of the drive segments 17 while operating in the guide path or tube 29, typically as illustrated in FIG. 8**.

It will be appreciated by those skilled in the art that the down-hole drilling apparatus **1*a* which utilizes the sectional drive system 1 of this invention can be sized such that the housing 2 will fit inside substantially any well casing. For example, under circumstances where the casing inside diameter is 4.09 inches, the diameter of the housing 2 can be about 3.75 inches. Under these circumstances, the radius of curvature of the guide path or tube 29 should be about 3 inches to facilitate a smooth curvature in which to stack the respective drive segments 17 of the sectional drive system 1. Under circumstances where the casing inside diameter is 5.012 inches, a down-hole drilling apparatus housing outside diameter of about 4.75 inches can be used, with a guide path defined by a guide path or tube 29 having a radius of curvature equal to about 4 inches. Furthermore, the drive segments 17, as well as the segment bit 28, can be manufactured to selected specifications, depending upon the size of the housing 2, the desired size of the drain hole 35 and the character of the producing interval 9**.

It will be further appreciated by those skilled in the art that the down-hole drilling apparatus **1*a* utilizing the sectional drive system 1 of this invention can be used in substantially any application where one or more transverse, offset holes must be drilled from a primary bore. Accordingly, the apparatus is not limited to use in drilling drain holes in oil and gas wells, but may also be used in such applications as flexible couplings for misaligned shafts or incorporated within a down-hole drilling motor of any design to form an articulated drill motor, or conduit installation and other applications where transverse off-shoot tunnels are desired from the primary bore. Other applications of the sectional drive system 1 include the provision of application of torque and thrust in a straight line or along a deviation from the straight line up to or even beyond ninety degrees, wherein the drive segments 17** articulate in any desired direction. Accordingly, typical applications include "CV" joints and mechanical couplings in vehicles, mud motors and other applications involving misaligned drive and driven systems. Application to dental drills may also be effected under circumstances where the dental drill drive train must necessarily be curved over a selected radius from the drive motor to the application or drill end. The device may also be used in tools such as flexible shaft screw drivers and similar applications, in non-exclusive particular.

It is significant that the sectional drive system 1 of this invention may also be operated to eliminate the necessity for using "whipstock" tools, described above, since, referring again to FIG. 11 of the drawings, the housing 2 of the down-hole drilling apparatus **1*a* can be precisely positioned in the well bore 6 of a well and a hole may be drilled in the casing 7 as illustrated in FIG. 8 and described above. However, instead of penetrating the cement sheath 8 and the producing interval 9, when the segment bit 28 drills through the casing 7, the down-hole drilling apparatus 1*a* can then be slowly lowered in the well bore 6 to cut a slot or window of desired length in the casing 7 and facilitate offset drilling through that window. Offset drilling can then be effected through this window, either conventionally or by means of a down-hole drilling apparatus 1*a* which incorporates the sectional drive system 1** of this invention, as desired.

It will be appreciated by those skilled in the art that the drive segments 17 can be constructed of substantially any material, depending upon the application.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A sectional drive system for coupling a drive to an output, comprising at least two segments connected to the drive and the output, said segments comprising a round head, multiple asymmetrical exterior splines tapering in spaced relationship with respect to each other from said round head to define spline edges, said spline edges of said asymmetrical exterior splines terminating in a tip and said asymmetrical exterior splines defining multiple asymmetrical interior spline seats disposed at a rotational offset angle in the range of from about 4 degrees to about 8 degrees displaced from said asymmetrical exterior splines, for receiving said asymmetrical exterior splines of adjacent ones of said segments, whereby said segments are interlocked in stacked relationship to connect the drive to the output.

2. The sectional drive system of claim 1 comprising an opening provided in said segments and cable means extending through said opening, whereby said segments are slidably mounted on said cable means.

3. The sectional drive system of claim 1 wherein said multiple asymmetrical exterior splines and said multiple asymmetrical interior spline seats comprise eight asymmetrical exterior splines and eight asymmetrical interior spline seats.

4. The sectional drive system of claim 1 wherein said multiple asymmetrical exterior splines and said multiple asymmetrical interior spline seats comprise eight asymmetrical exterior splines and eight interior spline seats and comprising an opening provided in said flat tip of said segments and cable means extending longitudinally through said opening, whereby said segments are slidably mounted on said cable means.

5. The sectional drive system of claim 1 comprising a drive face protruding from said asymmetrical exterior splines for engaging said asymmetrical interior spline seats in driving relationship.

6. The sectional drive system of claim 5 wherein said drive face protrudes from said asymmetrical exterior splines at a drive face angle in the range of from about 80 degrees to about 90 degrees with respect to said spline edges of said asymmetrical exterior splines.

7. The sectional drive system of claim 1 comprising a driven face protruding from said asymmetrical interior spline seats for engaging said asymmetrical exterior splines in driven relationship.

8. The sectional drive system of claim 7 wherein said driven face protrudes from said asymmetrical interior spline seats at a driven face angle in the range of from about 80 degrees to about 90 degrees with respect to said spline edges of said asymmetrical exterior splines.

9. The sectional drive system of claim 1 comprising:

(a) a drive face protruding from said asymmetrical exterior splines for engaging said asymmetrical interior spline seats in driving relationship; and (b) a driven face protruding from said asymmetrical interior spline seats for engaging said asymmetrical exterior splines in driven relationship.

10. The sectional drive system of claim 9 wherein said drive face protrudes from said asymmetrical exterior splines at a drive face angle in the range of from about 80 degrees to about 90 degrees with respect to said spline edges of said asymmetrical exterior splines.

11. The sectional drive system of claim 9 wherein said driven face protrudes from said asymmetrical interior spline seats at a driven face angle in the range of from about 80 degrees to about 90 degrees with respect to said spline edges of said asymmetrical exterior splines.

12. The sectional drive system of claim 9 wherein:

(a) said drive face protrudes from said asymmetrical exterior splines at a drive face angle of about 85 degrees with respect to said spline edges of said exterior asymmetrical splines; and (b) said driven face protrudes from said asymmetrical interior spline seats at a driven face angle of about 85 degrees with respect to said spline edges of said asymmetrical exterior splines.

13. The sectional drive system of claim 1 wherein said rotational offset angle is about 6 degrees.

14. The sectional drive system of claim 13 comprising:

(a) a drive face protruding from said asymmetrical exterior splines for engaging said asymmetrical interior spline seats in driving relationship; and (b) a driven face protruding from said asymmetrical interior spline seats for engaging said asymmetrical exterior splines in driven relationship.

15. The sectional drive system of claim 14 wherein:

(a) said drive face protrudes from said asymmetrical exterior splines at a drive face angle of about 85 degrees with respect to said spline edges of said asymmetrical exterior splines; and (b) said driven face protrudes from said asymmetrical interior splines at a driven face angle of about 85 degrees with respect to said spline edges of said asymmetrical exterior splines.

16. A down-hole drilling apparatus for boring holes in a production interval of an oil or gas well comprising:

(a) a tubular housing having a diameter of sufficient size to fit in the well;

(b) at least one guide means provided in said housing, with one end of said guide means engaging the wall of said housing and the opposite end of said guide means curving upwardly to define substantially a 90-degree arc;

(c) a plurality of driving segments engaging said guide means, each of said segments having a round head and multiple, asymmetrical exterior splines tapering in spaced relationship with respect to each other from said round head to define peripheral edges to a tip, said asymmetrical exterior splines defining multiple asymmetrical interior spline seats disposed at a rotational angle in the range of from about 4 degrees to about 8 degrees displaced from said asymmetrical exterior splines, for receiving said asymmetrical exterior splines of adjacent ones of said segments, whereby said segments are interlocked in stacked relationship to connect the drive to the output.

(d) drill bit means engaging the bottom one of said driving segments in said drive string; and (e) drive means slidably mounted in said tubular housing and engaging the top one of said driving segments to effect rotation of said drive string and boring of said drill bit means into said production interval responsive to slidable descent if said drive means in said tubular housing.

17. The sectional drive system of claim 16 comprising an opening provided in said segments and cable means extending through said opening, whereby said segments are slidably mounted on said cable means.

18. The sectional drive system of claim 16 wherein said multiple asymmetrical exterior splines and said multiple asymmetrical interior spline seats comprise eight asymmetrical exterior splines and eight asymmetrical interior spline seats.

19. The sectional drive system of claim 16 comprising:

(a) a drive face protruding from said asymmetrical exterior splines for engaging said asymmetrical interior spline seats in driving relationship; and (b) a driven face protruding from said asymmetrical interior spline seats for engaging said asymmetrical exterior splines in driven relationship.

20. The sectional drive system of claim 19 wherein said multiple asymmetrical exterior splines and said multiple asymmetrical interior spline seats comprise eight asymmetrical exterior splines and eight asymmetrical interior spline seats and comprising an opening provided in said flat tip of said segments and cable means extending longitudinally through said opening, whereby said segments are slidably mounted on said cable means.

* * * * *